United States Patent [19]

Copeland

[11] 4,298,447

[45] Nov. 3, 1981

[54] CATHODE AND CELL FOR LOWERING HYDROGEN OVERVOLTAGE IN A CHLOR-AKALI CELL

[75] Inventor: Terry M. Copeland, Wilmington, Del.

[73] Assignee: E. I. Du Pont de Nemours and Company, Wilmington, Del.

[21] Appl. No.: 128,111

[22] Filed: Mar. 7, 1980

[51] Int. Cl.[3] ..... C25B 11/04

[52] U.S. Cl. ..... 204/252; 204/290 R; 204/292

[58] Field of Search ..... 204/98, 128, 181 C, 204/16, 292, 98, 128, 290 R, 252, 7, 8

[56] References Cited

U.S. PATENT DOCUMENTS

| | | | |
|---|---|---|---|
| 2,642,654 | 6/1953 | Ahrens | 204/16 |
| 3,406,105 | 10/1968 | Letendre | 204/16 |
| 3,637,437 | 1/1972 | Goldberger | 136/120 FC |
| 4,105,516 | 8/1978 | Martinsons et al. | 204/98 |
| 4,116,804 | 9/1978 | Needes | 204/284 |
| 4,169,025 | 9/1979 | Needes | 204/98 |

FOREIGN PATENT DOCUMENTS

| | | | |
|---|---|---|---|
| 1054672 | 5/1979 | Canada | 204/292 |
| 8476 | 8/1979 | France | 204/129 |
| 2002032 | 6/1977 | United Kingdom | 204/252 |
| 1550890 | 8/1979 | United Kingdom | 204/292 |

*Primary Examiner*—R. L. Andrews

[57] ABSTRACT

The invention comprises an improved cathode for a chloralkali cell having grains of alpha-iron adherent to the surface of the cathode, and a process for making the cathode which comprises depositing grains of alpha-iron onto the surface of an electrically conductive cathode substrate in an electrical cell. The invention also provides a method for lowering the operating voltage of a chloralkali electrolysis cell which comprises adding iron particles to the cathode compartment of the cell.

11 Claims, No Drawings

CATHODE AND CELL FOR LOWERING HYDROGEN OVERVOLTAGE IN A CHLOR-AKALI CELL

BACKGROUND OF THE INVENTION

This invention concerns improvements in and relating to a cathode for a chlor-alkali cell, a method for making said cathode, and a method for lowering the hydrogen overvoltage of a chlor-alkali cell.

Production of caustic and chlorine by electrolysis of brine is well known in the art. The electrolysis is carried out in an electrolytic cell which consists in general of an anode, a cathode, an anode compartment and a cathode compartment. In one of the more recent types of such an electrolytic cell, the two compartments are separated from one another by a fluorine-containing cation exchange membrane.

Such an electrolytic cell can be operated more efficiently and economically as the current efficiency is increased, and as the operating voltage is lowered. Inasmuch as very large quantities of caustic and chlorine are produced by electrolysis of brine daily, even very small improvements in the current efficiency and operating voltage of chlor-alkali cells will lead to saving of large amounts of money and conservation of large amounts of energy.

The operating voltage of a chlor-alkali cell is made up of a number of component parts, of which one is the voltage drop at the cathode, known as the hydrogen overvoltage. A lowering of the hydrogen overvoltage will result in lowering of the overall cell voltage and consequently make the process more economical.

It is therefore an object of this invention to provide an improved cathode for a chlor-alkali cell and a method for making that cathode.

It is another object of this invention to provide a method for lowering the hydrogen overvoltage of a chlor-alkali cell.

SUMMARY OF THE INVENTION

The above objects are accomplished by the present invention which, briefly, comprises in one embodiment a cathode having crystals of alpha-iron adherent to its surface.

More specifically, according to the present invention there is provided a cathode for use in electrolysis of an alkali metal halide comprising an electrically conductive cathode substrate and crystals of alpha-iron adherent to the surface of said cathode substrate.

There is also provided according to the present invention an electrolytic cell which includes that cathode.

There is also provided according to the present invention a process for making a cathode in an electrical apparatus which comprises a housing and an anode, said process comprising (a) placing in said housing an electrically conductive cathode substrate, an aqueous electrolyte having a pH no less than about 7, and particles comprising grains of alpha-iron in an amount of about 1 g or more per $dm^2$ of the included area of said cathode substrate, and (b) passing an electrical current between said anode and said cathode substrate until at least some of said grains of alpha-iron have adhered to said cathode substrate.

There is further provided a method for lowering the operating voltage of a chloralkali electrolysis cell which comprises an anode, a cathode, an anode compartment, a cathode compartment, and a fluorine-containing cation exchange membrane which separates the compartments, said method comprising adding particles comprising grains of alpha-iron in an amount of about 1 g or more per $dm^2$ of membrane area to said cathode compartment.

DETAILED DESCRIPTION OF THE INVENTION

In accordance with the invention, a cathode having crystals of alpha-iron on its surface provides a lowering of the hydrogen overvoltage at the cathode of a chloralkali cell.

Such a cathode is suitably made by adding to an electrical cell, which may be a chloralkali cell, a small amount of particles which comprise alpha-iron. Such particles may be of alpha-iron or may contain grains of alpha-iron along with other substances.

One suitable type of particle is filings of grey cast iron. Grey cast iron is predominantly alpha-iron, as determined by X-ray diffraction, and also contains about 5% $Fe_2O_3$ and about 1 to 2% each of carbon and silicon. When filings of grey cast iron are used to make the novel cathode, the particles of alpha-iron seen on the surface of the cathode are found to be smaller than the filings used as the source of alpha-iron. Although the explanation of this observation is not known, it is believed that the initial particles break down in the aqueous medium or caustic solution to provide grains of alpha-iron which deposit on the cathode. It is also possible that iron from the added particles is being reformed in some manner not yet understood to provide crystals of alpha-iron on the surface of the cathode. In any case, the invention as claimed below is not bound by any theory as to how or why the cathode, cell or processes operate as they do.

The particles of iron employed can be of various shapes, one suitable form being filings, as mentioned above. The particles can be of various sizes, for example, from a size which passes through a screen with 1.7-mm openings (10 mesh) or larger, to a size which passes through a screen with 0.15-mm openings (100 mesh) or smaller, preferably from a size which passes through a screen with 0.6-mm openings (30 mesh) to a size which passes through a screen with 0.24-mm openings (60 mesh). A suitable convenient size passes through a screen with 0.38-mm openings (40 mesh).

Crystals of alpha-iron from as small as about 0.1 micrometer in each dimension up to as large as about 10 micrometers in the largest dimension have been observed on the cathode of the invention. It is believed, however, that a cathode having crystals of considerably smaller or larger dimension adhered to its surface also exhibits a reduced hydrogen overvoltage.

The particles of alpha-iron deposited on the cathode are not permanently bonded to the cathode, and the deposit can easily be scraped from the cathode, yet the deposit is sufficiently adherent that the cathode can be removed from the cell and placed in a second cell without unduly disturbing the deposit, and the performance of the second cell is also improved.

The amount of iron particles employed does not appear to be critical. Amounts of about 1 g or more per $dm^2$ of membrane area separating the compartments of the cell are suitable. In the case of an electrical cell which does not contain an ion-exchange membrane, amounts of about 1 g or more per $dm^2$ of the included area of the cathode are suitable. Amounts of at least 1 g/dm$^2$ of membrane area or included area of the cathode are preferred. By "included area" of a cathode is meant the overall area included by the outline of the cathode (of generally flat configuration or deformed into a generally flat configuration).

If the iron particles employed are covered with a surface of iron oxide, little effect, if any, is observed in lowering the hydrogen overvoltage. Thus, the iron particles should have a surface which is at least in part iron metal. The greatest effect is observed if the surface of the particles is all iron metal, i.e., if there is no oxide on the surface. If there is oxide on the surface of the iron particles, the oxide should either be reduced to iron, for example with hydrogen, or removed from the particles. It is easier to remove the oxide, which can be accomplished by treating the particles of iron with an acid which will dissolve the oxide, such as phosphoric acid.

Use of the cathode of the invention in a chloralkali cell, or addition of iron particles to a chloralkali cell as described above, results in a lowered overall cell voltage, generally in the range of between 0.05 and 0.4 volts below that of the unmodified cathode, or below that before the addition was made, respectively. The improvement diminishes only slightly with time, if at all. Once a modified cathode has been prepared in this manner, the cathode can be removed and used in a different cell. A lower than normal voltage will also be observed in the second cell. Again the improvement diminishes only slightly, if at all, with time.

When particles of iron as described herein are added to an operating chloralkali cell, or when placed in a cell at startup, a reduction in voltage associated with the presence of alpha-iron on the cathode surface is in most cases observed almost immediately, but, for reasons not yet understood, in some cases the reduction in voltage has not been realized until after operation of the cell for a period up to about one day.

The cathode of the invention, made either in a cell having no cation-exchange membrane or in a membrane cell, both as exemplified in examples below, can be removed from the cell in which made and placed for use in a chloralkali cell of either the membrane type or the diaphragm type, both of which are well known in the art.

The invention is applicable with a wide variety of different types and shapes of cathodes used as the cathode substrate. Examples include mild steel and mild steel having a nickel surface, such as nickel plating or Raney nickel, in the form of sheets, rods or expanded metal. Electrodes having a Raney nickel surface are described, for example, in U.S. Pat. Nos. 4,116,804; 4,169,025, and 3,637,437.

The invention is useful with chloralkali cells containing any of the known types of cation exchange membranes suitable for use in that type of cell. Such membranes of fluorine-containing polymers include those disclosed in U.S. Pat. Nos. 3,282,875, 4,085,071; and 4,176,215, and South African patent publications 78/002224, 78/002225, and 78/002221, or fabricated from polymers described therein, but are not limited thereto.

Although the invention is applicable over a wide range of cell operating conditions, it ordinarily finds greatest use in cells operating at a current density of 7.5–50 Amps per dm$^2$ (0.5–3 amps per square inch), at 75°–90° C., while producing caustic at a concentration of 10–40% by weight, with an exit brine concentration of 15–25% by weight.

In most typical chloralkali cells of the membrane type of commercial size, the spacing between the anode and cathode is of the order of 3 to 8 mm. When the cell is assembled for use, the membrane can be mounted equidistant from the two electrodes, or closer to the anode or cathode, but is preferably closer to the anode. Because of possible swelling of the membrane in the aqueous medium and/or deformation of the membrane due to varying pressure in either the catholyte or anolyte, the membrane may actually contact either the anode or cathode. It is preferred to operate in such manner that the cathode is spaced away from the membrane by a nominal distance, generally about 1 to 6 mm, which spacing can be maintained, e.g., by maintaining the catholyte at a suitably higher pressure than the anolyte. In the examples to follow, the cathodes used are of expanded metal mesh having a few spacer bars ca. 3 mm thick mounted on the surface which faces the membrane, and the cells are assembled with the membrane ca. 1.5 mm from the anode surface, and ca. 1.5 mm from the spacer bars of the cathode, i.e., ca. 4.5 mm from the expanded metal portion of the cathode.

To further illustrate the innovative aspects of the present invention, the following examples are provided. The iron filings used in the examples are of the grey cast iron described above.

EXAMPLE 1

An electrolytic membrane cell for electrolysis of brine with 0.45 dm$^2$ active membrane area, using a nickel-plated, mild steel cathode, was started up at 31 A/dm and 80° C., producing 31–32 wt % NaOH. The membrane mounted in the cell during assembly comprised a 0.127 mm (5-mil) film of a copolymer of perfluoro(3,6-dioxa-4-methyl-7-octenesulfonyl fluoride) and tetrafluoroethylene having an equivalent weight of b 1100, and a 0.051-mm (2-mil) film of a copolymer of methyl perfluoro(4,7-dioxa-5-methyl-8-nonenoate) and tetrafluoroethylene having an equivalent weight of 1025, laminated to opposite sides of a fabric of fluorocarbon yarns (T28C) such that the two films contact one another in the openings in the fabric, and hydrolyzed so that the functional groups were sulfonic and carboxylic acid potassium salts. The surface of the membrane having carboxylic functionality faced toward the cathode. Over the first 14 days of operation, which was stable at 90–92% current efficiency, the cell voltage increased from 3.73 volts to 3.93 volts, at which point a small amount of iron filings (approx. 1 g, 40 mesh) was added to the cathode compartment. The voltage started to decrease immediately, and on the 20th day was 3.63 volts, with no change in current efficiency.

EXAMPLE 2

The cathode was removed from the cell of Example 1 at the end of the 20th day, and placed in another like cell started up in the same manner. No additional iron filings were added. After an initial four days at 3.68–3.76 volts, this cell operated at 3.55–3.65 volts for 89 days at 91–96% current efficiency.

EXAMPLE 3

An electrolytic membrane cell for electrolysis of brine with 0.45 dm$^2$ active membrane area, using a Ni-plated, mild steel cathode, producing 32 wt % caustic, was started up at 31 A/dm and 80° C. The membrane mounted in the cell during assembly was a 0.051-mm (2-mil) film of a copolymer of methyl perfluoro(4,7-dioxa-5-methyl-8-nonenoate) and tetrafluoroethylene having an equivalent weight of 1012, and hydrolyzed so that the functional groups were carboxylic acid potassium salt. After three weeks, stable operation resulted in 96–97% current efficiency and 3.8 to 3.9 volts. At the 25th day of operation, a small amount of iron filings (approx. 0.5 g, 40 mesh) treated with phosphoric acid and washed with water was added to the cathode compartment. An immediate decrease in operating voltage from 3.83 to 3.74 volts occurred. By the 28th day, the voltage was 3.40 volts, with no change in current efficiency. The cell continued this level of performance through 60 days on line at which time it was shut down.

EXAMPLE 4

An electrolytic membrane cell for the electrolysis of brine, with 0.45 $dm^2$ active membrane area, using a Ni-plated, mild steel cathode, producing 28 wt % caustic, was started up at 31 $A/dm^2$ and 80° C. The membrane mounted in the cell during assembly was a 0.178-mm (7-mil) film of a copolymer of perfluoro(3,6-dioxa-4-methyl-7-octenesulfonyl fluoride) and tetrafluoroethylene having an equivalent weight of 1150, treated on one side with ethylene diamine (EDA) to a depth of 0.038 mm (1.5 mils), having a fabric of fluorocarbon yarns (T 900G) embedded in the remaining sulfonyl fluoride layer, and having the remaining sulfonyl fluoride groups throughout hydrolyzed to sulfonic acid potassium salt. The EDA-treated side of the membrane faced toward the cathode. While the cell was operating at 3.90 volts, approx. 0.5 g of iron filings treated with phosphoric acid and washed thoroughly with water was added to the cathode compartment; two days later the cell voltage was 3.74 volts.

In a duplicate parallel experiment, the initial cell voltage was 4.00 volts, and two days after addition of iron filings was 3.84 volts.

EXAMPLE 5

An electrolytic membrane cell for the electrolysis of brine, with 0.45 $dm^2$ active membrane area, using a Ni-plated mild steel cathode, producing 20% caustic, was started up at 31 $A/dm^2$ and 80° C. The membrane mounted in the cell during assembly was a 0.127-mm (5-mil) film of a copolymer of perfluoro(3,6-dioxa-4-methyl-7-octenesulfonyl fluoride) and tetrafluoroethylene having an equivalent weight of 1200, having a fabric of fluorocarbon yarns (T-12) embedded therein, and having the sulfonyl fluoride groups hydrolyzed to sulfonic acid potassium salt. While the cell was operating at 4.16 volts, 0.5 g of iron filings (40 mesh) treated with phosphoric acid and washed with water was added to the cathode compartment. By the next morning the voltage had decreased to 4.00 volts, with no change in current efficiency.

EXAMPLE 6

An electrolytic membrane cell for the electrolysis of brine, with 0.45 $dm^2$ active membrane area, using a Ni-plated mild steel cathode, producing 10% caustic, was started up at 31 $A/dm^2$ and 80° C. The membrane mounted in the cell during assembly was a laminate of a 0.025-mm (1-mil) film of a copolymer of perfluoro(3,6-dioxa-4-methyl-7-octenesulfonyl fluoride) and tetrafluoroethylene having an equivalent weight of 1500 and a 0.127-mm (5-mil) film of a copolymer of the same two monomers having an equivalent weight of 1100, having a fabric of fluorocarbon yarns (T 24C) embedded in the layer of equivalent weight 1100, and having the sulfonyl groups throughout hydrolyzed to sulfonic acid potassium salt. The surface of the membrane of 1500 equivalent weight polymer faced toward the cathode. While the cell was operating at 4.60 volts, 0.5 g of iron filings (40 mesh) treated with phosphoric acid and washed with water was added to the cathode compartment. The voltage decreased immediately to 4.45 volts, and by the next morning had decreased to 4.33 volts, with no change in current efficiency.

EXAMPLE 7

An electrolytic membrane cell for electrolysis of brine, with 0.45 $dm^2$ active membrane area, using a cathode of mild steel having a Raney nickel surface of the kind described in U.S. Patent 4,116,804, producing 31–32% caustic, was started up at 31 $A/dm^2$ and 80° C. The membrane mounted in the cell during assembly was a fabric of fluorocarbon polymer filaments (0.127 mm, or 5 mil, diameter) in a Leno weave having 68% open area, having laminated to one side a 0.102-mm (4-mil) film of a copolymer of perfluoro(3,6-dioxa-4-methyl-7-octenesulfonyl fluoride) and tetrafluoroethylene having an equivalent weight of 1100 and to the other side a 0.051-mm (2-mil) film of the same copolymer such that the two films contact one another in the openings in the fabric, further having a 0.051-mm (2-mil) film of a copolymer of methyl perfluoro(4,7-dioxa-5-methyl-8-nonenoate) and tetrafluoroethylene having an equivalent weight of 1012 laminated to the indicated 4-mil film, and hydrolyzed so that the functional groups were sulfonic and carboxylic acid potassium salts. The side of the membrane having carboxylic functionality faced toward the cathode. The cell started up at 3.76 volts, but by the next morning the voltage was 3.53 volts and for three days operation was stable at 3.46–3.56 volts and 96–97% current efficiency. On the 4th day of operation, a small amount (approximately 0.5 g, 40-mesh) of iron filings treated with phosphoric acid and washed with water was added to the cathode compartment. By the next day the voltage had dropped to 3.32 volts, at the same current efficiency of 96–97%. For the next seven days the voltage remained in the range of 3.23–3.40 volts at current efficiencies of 94–97%.

EXAMPLE 8

An electrolytic membrane cell for electrolysis of brine, with 0.45 $dm^2$ active membrane area, using a cathode of nickel-plated mild steel, producing 31–32% caustic, was started up at 31 $A/dm^2$ and 80° C. The membrane and its orientation were like those specified in Example 7. After twenty days of stable operation at 4.03–4.08 volts and 94–95% current efficiency, the cell was shut down. While the cell was shut down, approximately 1 g of iron filings (40 mesh) which had been treated with phosphoric acid and washed with water was added to the cathode compartment. The cell was restarted; during the first day after restarting the voltage fell from 4.02 volts to 3.86 volts, and for the next three days the voltage was 3.78–3.84 volts at 94–96% current efficiency.

EXAMPLE 9

An electrolytic membrane cell for electrolysis of brine, with 0.45 $dm^2$ active membrane area, using a cathode of nickel-plated mild steel, producing 31–32% caustic; was started up at 31 A/dm$^2$ and 80° C. The membrane and its orientation were like those specified in Example 7. After a few days of unsettled operation, stable operation was attained for 31 days at 3.97–4.02 volts and 95–96% current efficiency. Then, with the cell still in operation, approximately 1 g of iron filings (which passed through a 100 mesh screen) which had been treated with phosphoric acid and washed with water was added to the cathode compartment. Although there was considerable loss of iron particles from the cell in the caustic stream flowing from the cathode compartment, some of the iron particles remained in the cell, and the cell operated at 3.84–3.87 volts and 93–97% current efficiency for six days, after which the cell was briefly shutdown for removal of the cathode so that the cell could be used for another experiment.

EXAMPLE 10

An electrical cell was assembled using two nickel-plated, expanded mesh, mild steel electrodes, each being 7.6 cm in diameter, one to serve as an anode and the other to serve as a cathode substrate. In this case, no membrane was used to separate the two cell compartments. Into the cell were placed a 30% by wt. solution of sodium hydroxide in water, and approximately 2 g of iron filings (40 mesh) which had been treated with phosphoric acid and washed with water. A current of 8.4 amps was passed between the electrodes for 2 hours, and after shutting down overnight, for another 2 hours the next morning. The cell was dismantled and the cathode (cathode A) was found to have a particulate deposit derived from the iron filings adherent to its surface.

The procedure of the previous paragraph was substantially repeated, except that the current of 8.4 amps was passed between the electrodes for 5 hours on the first day, and after interruption overnight, for 6 hours the next day, to provide a similar cathode (cathode B).

When the chloralkali cell of Example 9 was shut down at the end of that example, the cathode of that cell was removed and replaced with cathode A from above, the cell was again started up immediately, and electrolysis of brine was continued. The cell operated at 3.78–3.84 volts at 94–95% current efficiency for 8 days. This voltage is approximately 0.2 volts below the voltage of 3.97–4.02 volts at which this cell had operated with a plain nickel-plated mild steel cathode.

The chloralkali cell was shut down for one hour, during which time cathode A was replaced by cathode B. The cell operated for three days at 3.83–3.90 volts mostly at 3.83–3.86 volts, and 95–96% current efficiency.

The cell was again shut down for one hour, during which time cathode B was replaced by a standard nickel-plated mild steel cathode. The voltage rose, and the cell operated at 3.89–4.01 volts, mostly at 3.95–4.00 volts, and 95–96% current efficiency, for the next 40 days.

EXAMPLE 11

An electrolytic membrane cell for electrolysis of brine, with 0.45 dm$^2$ active membrane area, using a cathode of mild steel, producing 31–32% caustic, was started up at 31 A/dm$^2$ and 80° C. The membrane and its orientation were like those specified in Example 7. On the 13th day of operation, after stable operation at 3.98–3.99 volts and 97–98% current efficiency had been attained, approximately 1 g of iron filings (40 mesh) which had been treated with phosphoric acid and washed with water was added to the cathode compartment. For the next 94 days the cell operated at 3.70–3.88 volts and 92–98% current efficiency (with the exception of a 3-day period at 3.64–3.68 volts and 81–92% current efficiency when another chloralkali cell connected in series with this cell shorted out). At the end of this period, the cell was briefly shut down, the cathode (cathode C) was replaced by a standard nickel-plated cathode, and the cell was restarted, after which the voltage rose to 3.90–3.95 volts at 95–97% current efficiency.

Photomicrographs of cathode C as removed from the cell revealed on its surface crystals of alpha-iron. The crystals ranged in size from small ones about 0.1 micrometer in each of its three dimensions to larger ones about 10 micrometers long in their longest dimention.

Industrial Applicability

The invention is useful broadly in the chloralkali industry for providing a more efficient and economical operation of chloralkali cells. For example, for a plant producing 1000 metric tons of caustic per day, operating at 90% current efficiency with power costs of $0.02/kilowatt hour, there is an annual savings of $544,000 for each reduction in operating voltage of 0.1 volt. Thus, if an average voltage reduction of 0.2 volt is achieved, the saving for such a plant would be in excess of one million dollars per year. Beyond the actual monetary savings, there is also a corresponding saving in the world's energy reserves.

I claim:

1. A cathode for use in electrolysis of an alkali metal halide comprising an electrically conductive cathode substrate and deposited particles consisting essentially of crystals of alpha-iron adherent to the surface of said cathode substrate.

2. The cathode of claim 1 wherein said cathode substrate is mild steel or mild steel having a nickel surface.

3. The cathode of claim 2 wherein said substrate is mild steel having a nickel surface and said nickel surface is Raney nickel.

4. A cathode for use in electrolysis of an alkali metal halide comprising an electrically conductive cathode substrate and a particulate deposit consisting essentially of particles derived from particles of grey cast iron adherent to the surface of said cathode substrate, the amount of said particles of grey cast iron being about 1 g or more per dm$^2$ of the included area of said cathode substrate.

5. The cathode of claim 4 wherein said particles of grey cast iron are acid-washed particles.

6. The cathode of claim 5 wherein said cathode substrate is mild steel or mild steel having a nickel surface.

7. The cathode of claim 6 wherein said substrate is mild steel having a nickel surface and said nickel surface is Raney nickel.

8. The cathode of claim 5 wherein said particles of grey cast iron are from a size which passes through a screen with 1.7-mm openings to a size which passes through a screen with 0.15-mm openings.

9. An electrolytic cell which comprises an anode, a cathode of claim 1 or 4, an anode compartment, a cathode compartment, and a separator positioned between said compartments.

10. The cell of claim 9 wherein said separator is a fluorine-containing cation-exchange membrane.

11. The cell of claim 9 wherein said separator is a diaphragm.

* * * * *